US008771457B2

(12) United States Patent
Mockry et al.

(10) Patent No.: US 8,771,457 B2
(45) Date of Patent: Jul. 8, 2014

(54) FILL PACK ASSEMBLY AND METHOD WITH BONDED SHEET PAIRS

(75) Inventors: Eldon F. Mockry, Lenexa, KS (US); Ohler L. Kinney, Jr., Overland Park, KS (US); Kenneth P. Mortensen, Bonner Springs, KS (US); Glenn S. Brenneke, Lee's Summit, MO (US)

(73) Assignee: SPX Cooling Technologies, Inc., Overland Park, KS (US)

( * ) Notice: Subject to any disclaimer, the term of this patent is extended or adjusted under 35 U.S.C. 154(b) by 749 days.

(21) Appl. No.: 12/340,324

(22) Filed: Dec. 19, 2008

(65) Prior Publication Data

US 2010/0159209 A1 Jun. 24, 2010

(51) Int. Cl.
*B29C 65/14* (2006.01)

(52) U.S. Cl.
USPC ..... 156/272.2

(58) Field of Classification Search
USPC ..... 156/182, 272.2
See application file for complete search history.

(56) References Cited

U.S. PATENT DOCUMENTS

| | | | | |
|---|---|---|---|---|
| 4,892,604 | A * | 1/1990 | Measells et al. | 156/244.24 |
| 5,217,788 | A * | 6/1993 | Rye | 428/184 |
| 5,944,094 | A | 8/1999 | Kinney, Jr. et al. | |
| 2008/0116592 | A1 * | 5/2008 | James | 261/23.1 |
| 2010/0015385 | A1 | 1/2010 | Woicke | |

FOREIGN PATENT DOCUMENTS

| | | |
|---|---|---|
| DE | 102006061043 A1 | 6/2008 |
| GB | 571510 | 8/1945 |
| GB | 1314179 | 4/1973 |

* cited by examiner

*Primary Examiner* — Daniel McNally
(74) *Attorney, Agent, or Firm* — Baker & Hostetler LLP

(57) ABSTRACT

A fill pack assembly and method for assembling a fill pack from individual sheets utilizes integrally bonded sheet pairs. Each sheet pair is a pair of two individual adjacent fill sheets which have been bonded together via any suitable bonding method. A plurality of the thus formed sheet pairs can then be attached together to form an entire fill pack or portion of a fill pack. Such fill packs are useful in heat exchange devices such as industrial cooling towers.

7 Claims, 5 Drawing Sheets

FILL PACK ASSEMBLY AND METHOD WITH BONDED SHEET PAIRS

FIELD OF THE INVENTION

The invention pertains generally to the construction of fill packs which are used, for example, in heat exchange towers. Such fill packs are made from pluralities of thin sheets which are stacked into fill packs and are used in some instances in a cooling tower to cool process water.

BACKGROUND OF THE INVENTION

Heat exchange towers are in wide use in industry. These heat exchange towers include, for example, a variety of well known cooling towers, which in some instances may be used to cool process water from an industrial operation. Such cooling towers often involve the spraying of a relatively warm water over a fill pack. The fill pack often includes parallel adjacent corrugated sheets so that the water will tend to have a significant surface area contact with the ambient air, and thus be cooled by the ambient air. Fill packs also may be utilized simply to have air passing through them for heat exchange between one air path and another air path.

In some instances, the fill packs are made up of a plurality of corrugated sheets, with the sheets running generally in parallel to each other and being laid in parallel with each other. The corrugated sheets generally have their corrugations either offset from each other or at an angle to each other so that air spaces are formed in between the sheets. The sheets may also have, in addition to, or instead of corrugations, other registration features or aligned dimples or other indentations which can be aligned with each other in order to provide registration and/or a desired spacing between the sheets.

A simple stack of corrugated sheets lying on top of each other or adjacent each other can have the disadvantage that such an assembled pack is not very rigid, and thus can be susceptible to damage. Further, if the sheets are merely adjacent each other there may be a tendency for some spacing to occur between the sheets. In addition, sheets which are not somehow mechanically attached to each other can suffer the disadvantage of a sheet falling out, especially since in many instances the sheets are oriented vertically in their final installation.

Further, a large cooling tower installation may require a very large volume of fill pack material. It has been known to create medium size modules each having a large number of sheets, and to be able to transport and handle these modules individually at the fabrication site of a tower. It is desirable in some environments that these modules have all the sheets well attached together in order to facilitate such handling and installation.

Many methods have been known for creating a fill pack module. In this application, the concepts of a multi-sheet fill pack, and a multi-sheet fill pack module, will be used interchangeably after fill packs are assembled with the sheets horizontally stacked, but one then installed with the sheets vertically oriented. One method has involved the supply of a first single sheet and a second single sheet, with first and second sheets being bonded together using heat bonding or using an adhesive or solvent material. Then, a third single sheet is laid onto the first two sheets, again with an adhesive or bonded material in between. A fourth single sheet is laid on to the three sheets using an adhesive or bonded material, and so on. This method has proved effective, but can be labor and time intensive. Another method for creating a fill pack has been to assemble all the sheets, without any bonding, and to hold them together using a fixture, and then to apply some form of solvent, either before stacking the sheets, or by running or deluging the solvent through the spaces in between the sheets. Then, the entire fill pack is cured or allowed to bond and the pack can be removed. This method is also successful, but has the disadvantage of requiring a relatively elaborate fixture and also the need to use solvents, which may present environmental or safety issues such as VOC emissions or combustion hazards. Large quantities of solvent used to deluge the pack contact points exacerbate environment and safety issues. The deluge method may have the further disadvantage of not reliably bond contact points throughout large packs.

It would be desirable to have a structure and method for fill pack construction, which could be cost effective, easy, convenient, and/or reduce the use of chemicals compared to some prior art methods.

SUMMARY OF THE INVENTION

The present invention discloses a fill pack assembly and method for assembling a fill pack from individual sheets utilize integrally bonded sheet pairs. Each sheet pair is a pair of two individual adjacent fill sheets which have been bonded together via any suitable bonding method. A plurality of the thus formed sheet pairs can then be attached together to form an entire fill pack or portion of a fill pack. Such fill packs are useful in heat exchange devices such as industrial cooling towers.

The fill pack assembly integrally bonds two individual adjacent fill sheets to each other to form a bonded sheet pair or more than one bonded sheet pair, and attaches two or more bonded sheet pairs to each other. This method also provides two individual sheets having three-dimensional features, which align the two sheets so that they are in contact with each other at contact locations, whereby the radio frequency (RF) welds the sheets together from opposite sides of the bonded sheet pair, to form a bonded sheet pair.

The invention further disclose a fill pack for use in an environmental heat exchange assembly with a plurality of bonded sheet pairs each comprising two sheets bonded to each other and means for attaching a plurality of the bonded sheet pairs to each other to form a fill pack.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
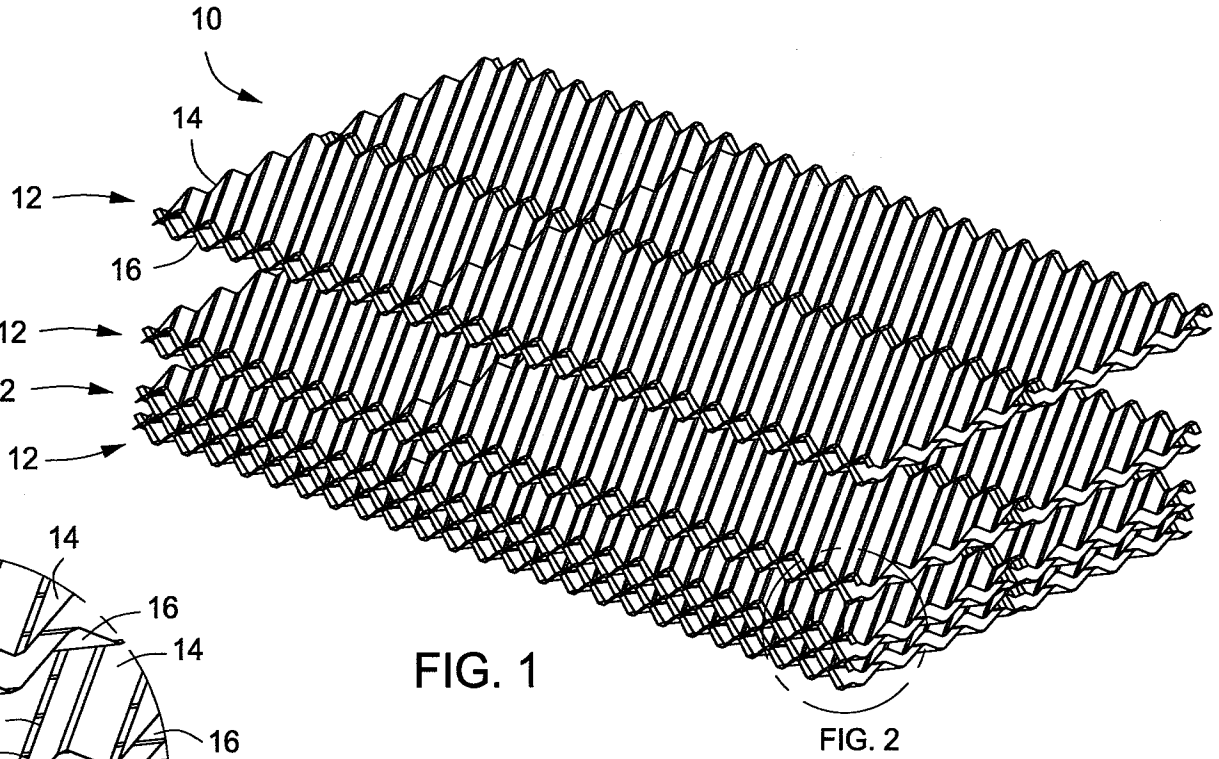
FIG. 1 is a perspective cutaway view of a fill pack utilizing four bonded sheet pairs.

Some embodiments of the present invention provide apparatuses and methods for fill pack assembly using bonded fill sheet pairs. The fill pack assembly and method for assembling a fill pack from individual sheets utilize integrally bonded sheet pairs. Each sheet pair is a pair of two individual adjacent fill sheets which have been bonded together via any suitable bonding method. A plurality of the thus formed sheet pairs can then be attached together to form an entire fill pack or portion of a fill pack. Such fill packs are useful in heat exchange devices such as industrial cooling towers. Some embodiments of the present invention will now be described below with reference to the drawing figures, in which like reference numerals refer to like parts throughout.

In some embodiments, a fill pack is constructed using the following method. First, two opposed sheets are attached to each other to form an essentially unitary bonded sheet pair. In this application, the term bonded is used broadly to cover any attachment of the two sheets into a corrugated, essentially unitary pair, and thus includes but is not limited to thermal, adhesive, and chemical attachment, as well as interlocking attachment of a pair of single sheets, to each other. Attachment methods for attaching two sheets to each other to form a sheet pair may include a variety of methods including RF welding, heat bonding, twin-sheet vacuum forming, adhesives layered on the sheets or applied at the touching connecting points of the two sheets, or other chemical or thermal bonding methods between two sheets. Multiple integrally bonded sheet pairs can then be assembled together to form a fill pack. The multiple bonded sheet pairs can be held adjacent to each other by themselves being bonded, glued, or welded to each other, or can be held together mechanically via attachment tubes, pins, or a confining frame. In some instances, sets of three or even more sheets can be first attached to each other to form a sheet group, and then multiple ones of these multiple sheet groups can be attached to each other, thereby creating a modular assembly process.

An advantage of the arrangement described herein is that the sheet pairs themselves are quite rigid compared to an individual sheet. This provides a great deal of rigidity to the overall resulting fill pack structure, and also provides for ease of handling during the assembly of the pairs to each other, because the pairs themselves are much stiffer than individual sheets would be. This effect is increased if the group is more than a pair, e.g., a three sheet group.

Turning to FIGS. 1-5, an example of fill pack construction using integrally bonded pairs is shown. FIG. 1 shows an exploded view of a fill pack 10 with four sheet pairs 12. Each sheet pair 12 is made up of an upper sheet 14 and a lower sheet 16. In the example illustrated, the sheets 14 and 16 are identical to each other, but have been reversed in orientation relative to each other, so that they are cross-corrugated. That is, the diagonal corrugations on sheet 14 are arranged to be at an opposite angle to the diagonal corrugations of sheet 16.

Figure 2:
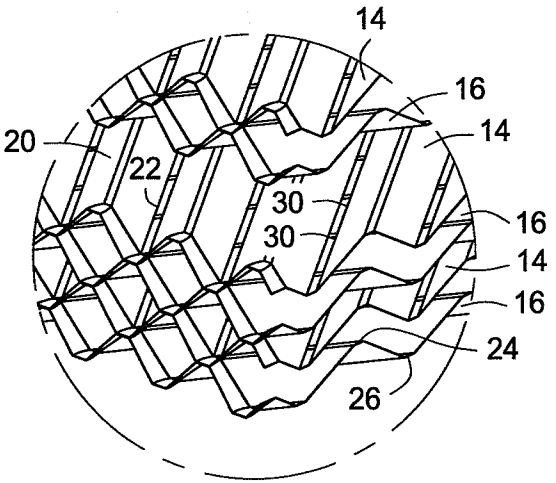
FIG. 2 is a detailed view of the detail area A in FIG. 1.

Turning to FIG. 2, it will be seen that upper sheet 14 has peaks 20 and valleys 22. Similarly, the lower sheet 16 has peaks 24 and valleys 26. When the two sheets 14 and 16 are laid on top of each other, the peaks and valleys meet at touching points 30. In the example illustrated in FIG. 2, the peaks and valleys have a flat horizontal profile. That is, the peaks and valleys are not pointed at an angle, nor are they rounded. Rather, they have been formed so that they have flat faces and these flat faces rest on each other flushly at their diagonal crossing points 30. This creates a parallelogram-shaped contact touching region 30. At this touching regions 30, two sheets can be bonded or attached to each other to form a sheet pair. One method of bonding or attaching these diagonal peaks and valleys to each other is accomplished via the use of a radio frequency (RF) welding machine. Such an RF welding machine can have metallic bars roughly the width of a peak and valley that will rest in the opposed peaks and valleys while electricity is supplied therethrough. As electricity is supplied to the bars, a thermal bond is formed at the touching regions 30. RF welding of a sheet pair in this method will typically be accomplished then by having an assembly of metal rods or bars that close on to the sheet pair from both sides of the sheet pair. Depending on the configuration of corrugations and other features in the sheets, it may be possible to weld three or more sheets together in this fashion to form a sheet group.

Although a diagonal cross-corrugated sheet pair is illustrated, it will be appreciated that the sheets may have any features disposed thereon and thus are applicable to cross-flow fills, counter-flow fills, cross-corrugated fills, non cross-corrugated fills, and other media. In addition, although the illustrated embodiment shows most or all of the contact points between the fill being bonded or welded together, other registration features such as nesting may be used at various contact points between the sheet pairs. In addition to the contact points 30, there may be additional locations of joining of two sheets in a sheet pair with each other, as illustrated in FIGS. 3-5.

Figure 3:
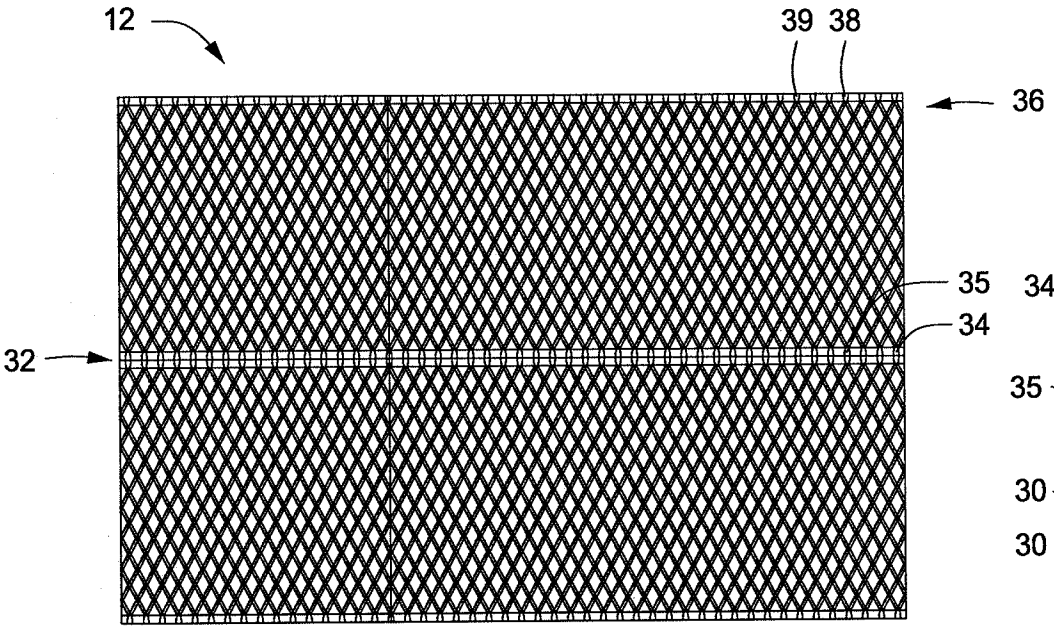
FIG. 3 is a top view of a single bonded sheet pair.
Figure 4:
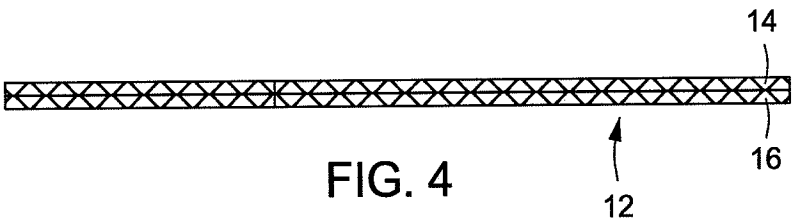
FIG. 4 is a side view of a single bonded sheet pair.

FIG. 3 illustrates a sheet pair 12 having a longitudinal mounting section 32. The longitudinal mounting section 32 includes a relatively flat strip having attachment dimples 34. In this example longitudinal mounting section 32 is created by redirecting the cross-corrugations to be collinear which creates a honeycomb pattern. When the sheets are arranged in a cross-corrugated fashion, the alternating ones of opposing dimples 34 on each sheet align with each other and touch with each other, providing an additional touching point 30. The interspersed alternating dimples 35 project outwardly away from the sheet pair, and thus can provide attachment locations for the mounting of one sheet pair to an adjacent sheet pair. In addition, an outer boundary border strip 36 is provided which has alternating dimples 38 and 39. The dimples 38 touch each other in a sheet pair, and can be bonded when forming a sheet pair, and the interspaced alternating dimples 39 face outwardly away on both sides of the sheet pair to provide for bonding between adjacent sheet pairs, if desired.

Looking at the embodiment of FIG. 3, it will be appreciated that further integral bonding between the two sheets of a pair can be accomplished in various manners. That is, in addition to bonding at the attachments points 30 along the diagonal peaks and valleys, the dimples 34 can be bonded to each other, either via an RF welding device, or by another spot weld technique or the application of a solvent or adhesive. In this way, sheets 14 and 16 can be attached together to form a sheet pair 12, as in FIG. 4.

Figure 5:
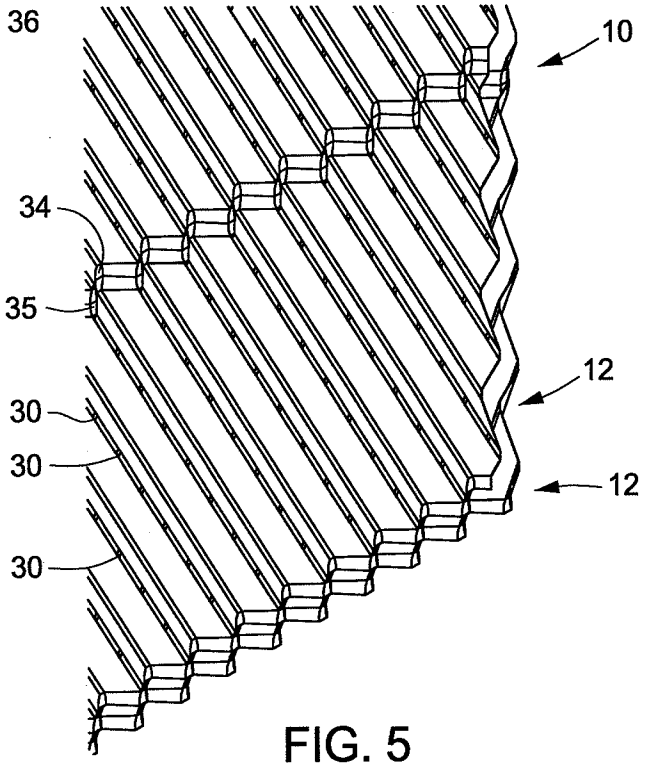
FIG. 5 is a perspective cutaway view of a fill pack having two bonded sheet pairs.

FIG. 5 is a cutaway view showing two sheet pairs 12 being attached to each other. The bond locations 30 and 34 of a first sheet pair set are shown. It will be appreciated that if two sheet pairs are stacked on each other, it is possible to easily bond the outwardly protruding dimples 39 (not shown in FIG. 5) to each other using a closed finger clamp type of RF welding arrangement, which needs only a reach in a small degree in between the sheets, roughly the size of the dimples 39 shown in FIG. 3. Performing this operation causes two sheet pairs 12 to be mounted to each other, as shown in FIG. 5. Each sheet pair 12 is significantly more rigid than an individual sheet would be. In addition, although the sheet pairs 12 in this example would be bonded to each other only around their perimeter, either four sides or two sides of the opposed dimple location 39, the resulting double sheet pair arrangement results in a four sheet pack which is desirably stiff. Depending on the overall corrugation configuration, it is also possible to develop a tool that reaches in further inside each sheet pair 12 and welds the adjacent sheets of any two adjacent sheet pairs together at other spots inside the plan view of the fill.

The method described above with respect to FIG. 5 can be repeated, so that sheet pack pairs 12 are built up onto each other and a sheet pack having any number of pairs, (and hence double that number of individual sheets) can be constructed easily. In this way, bonding of all the sheets to adjacent sheets, at least to some degree, is accomplished and a rigid fill pack is created.

Figure 6:
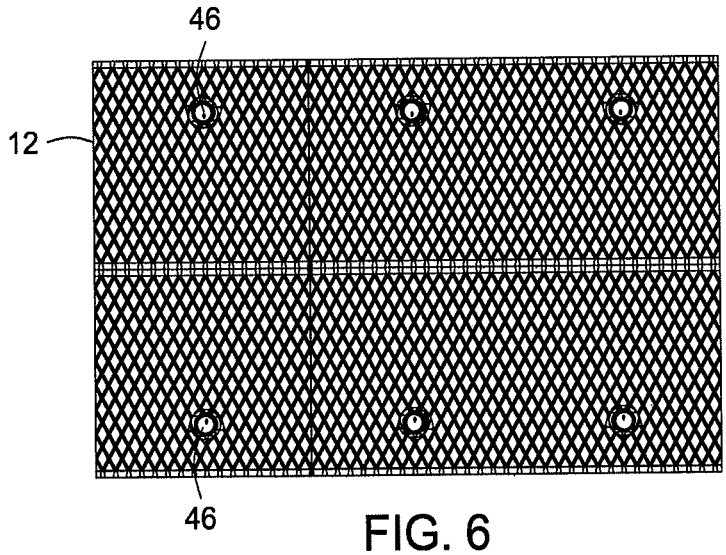
FIG. 6 is a top view of an embodiment of the invention utilizing transverse mounting tubes.
Figure 7:
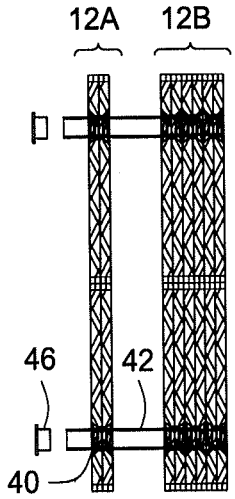
FIG. 7 is an end view of the embodiment of FIG. 6.
Figure 8:
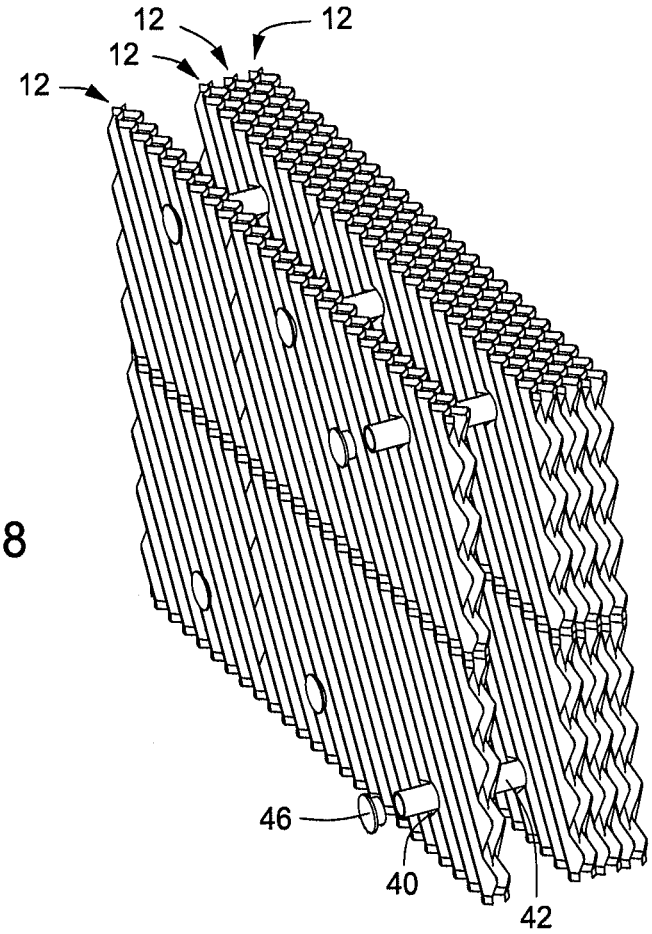
FIG. 8 is a perspective view of the embodiment of FIG. 6.

FIGS. 6-8 show an alternative embodiment of creating a fill pack. In this embodiment, sheet pairs are constructed as described above, but rather than bonding the sheet pairs together, the sheet pairs are mechanically attached to each other. Each individual sheet has a mounting aperture 40, through which passes a mounting tube 42. Caps 46 are provided to retain a fill pack together. FIG. 7 depicts a pair 12A in exploded view relative to a multi-pair set 12B. In the final installation fill pack configuration, more pairs would be added to fill the entire length of the mounting tube 42.

Figure 9:
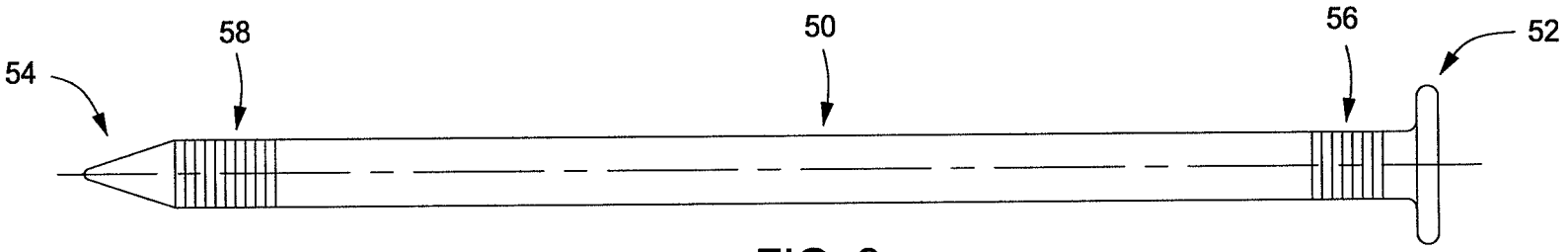
FIG. 9 is a top view of a mounting pin that can be used to hold sheet pairs together.
Figure 10:
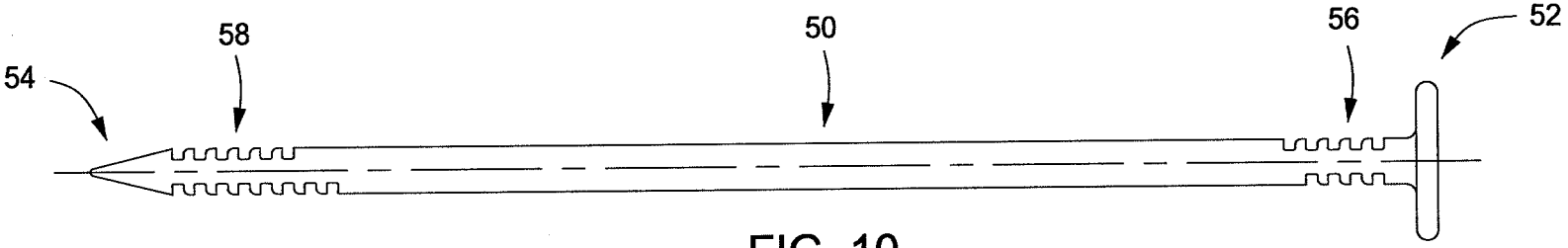
FIG. 10 is a side view of the mounting pin of FIG. 9.

FIGS. 9 and 10 depict another arrangement for attaching bonded sheet pairs to each other. In this example, a mounting pin 50 which has a head 52 and a tapered tip 54. Serrations 56 and 58 can be provided so that the mounting pin 50 will puncture through a number of sheet pairs and hold them together adjacent each other. The serrations may extend along the entire length between 56 and 58.

Figure 11:
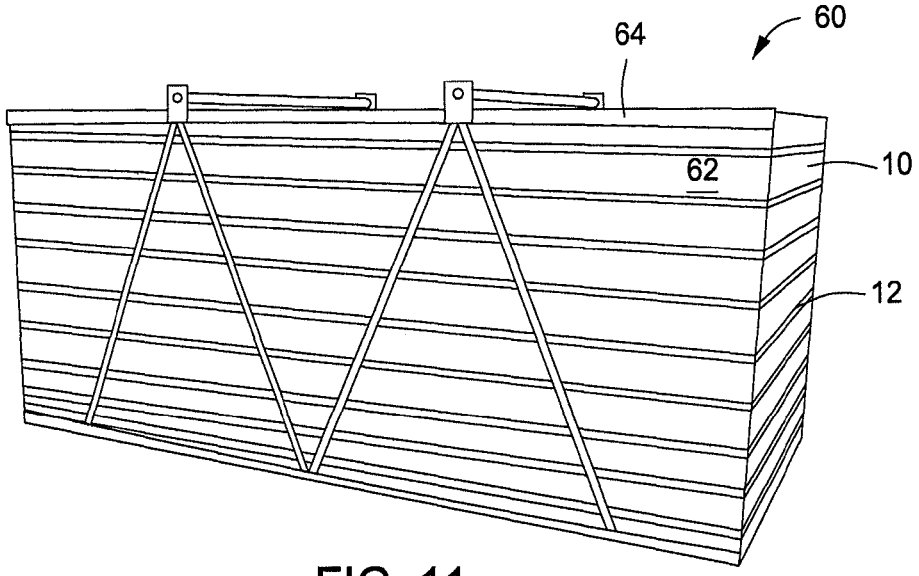
FIG. 11 is a perspective view of a confining frame for holding sheet packs together to form a fill pack.

FIG. 11 shows another alternative embodiment of mounting plural bonded sheet pairs to each other to form a fill pack. In this example, a confining frame 60 is provided having end walls 62 and an overall frame assembly 64 which essentially forms a box with an upper and lower framework to hold the fill pairs together.

In the above description, in keeping with various embodiments, of the invention, the individual sheets can be formed using any suitable method. For example, a hot melt press or a vacuum forming may be utilized for each sheet, to produce each sheet individually. However, since sheet pairs can be extensively utilized in some embodiments, twin sheet vacuum forming may also be utilized to form two sheets at the same time, and even to create a two-sheet bonded pair in essentially one step in the twin sheet vacuum former.

Figure 12:
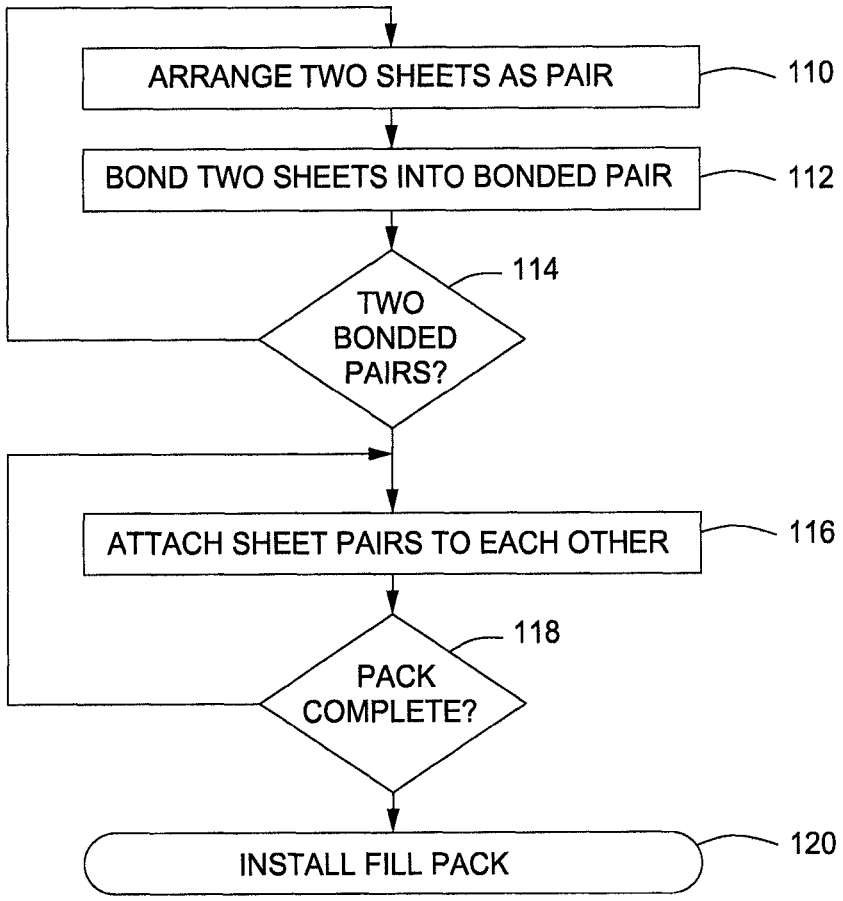
FIG. 12 is a flow chart of an exemplary method for assembling a fill pack from sheets using bonded sheet pairs/

FIG. 12 depicts one example of a method according to the present invention. In step 110, two sheets having some form of opposed or lined features are arranged as a pair. At step 112, the two sheets are bonded into an essentially integral bonded pair. At step 114 the process of forming bonded sheet pairs is repeated until at least two or more sheet pairs are present. At step 1 16, the two sheet pairs are attached to each other. Two or more sheet pairs are aligned with each other and either mechanically held, fastened to each other, or thermally molded, or chemically or otherwise attached to each other. Although this is referred to as attaching sheet pairs to each other, it will be appreciated that the sheet pairs may simply be mechanically held together or restrained in a suitable arrangement together.

At step 118, the process of attaching sheet pairs to each other is continued, using the necessary number of sheet pairs until the fill pack is deemed complete. At this point, at step 120, the fill pack can be transported, handled, installed, and/or mounted to other fill packs, and eventually used in final installation. As noted above, although this application illustrates as an embodiment the concept of sheet pairs which are then each individually placed together to form adjoining pairs to form a fill pack, individual sheets may actually be bonded together into layer groups such as sheet triplets, or even higher numbers, and these triplets where other multi-sheet assemblies can be assembled together as described above.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of assembling a fill pack from individual fill sheets, comprising:

integrally bonding two individual adjacent fill sheets, wherein each sheet has a perimeter and an internal contact point, wherein each contact point is one of a peak or a valley disposed within said perimeter and wherein each respective internal contact point engages the other contact point during assembly, to each other to form a bonded sheet pair;

repeating the step of integrally bonding two individual adjacent fill sheets to each other to form more than one bonded sheet pair; and attaching two or more bonded sheet pairs to each other, wherein said step of integrally bonding two individual sheets comprises placing the two individual adjacent fill sheets between a pair of electrodes and radio frequency (RF) welding the individual sheets along the perimeter only at the respective peak or valley internal contact point of the respective individual sheet.

2. The method of claim 1, further comprising repeating the steps of integrally bonding two individual adjacent fill sheets, and repeating the steps of attaching bonded sheet pairs to each other.

3. The method of claim 1, wherein the step of attaching two or more bonded sheet pairs to each other comprises radio frequency (RF) welding.

4. The method of claim 1, wherein the step of attaching two or more bonded sheet pairs together comprises holding them together using a mounting tube which passes through apertures in the bonded sheet pairs and has capped ends.

5. The method of claim 1, wherein the step of attaching two or more bonded sheet pairs together comprises inserting at least one mounting pin through the bonded sheet pairs.

6. The method of claim 1, wherein the step of attaching two or more bonded sheet pairs together comprises restraining the bonded sheet pairs within a restraining frame.

7. A method of producing a bonded sheet pair for a fill pack, comprising:

providing two individual sheets each having a perimeter and three-dimensional features including each having an internal contact point, wherein each contact point is one of a peak or a valley disposed within said perimeter and;

aligning the two sheets so that they are in contact with each other at contact points; and radio frequency (RF) welding the sheets together from opposite sides of the bonded sheet pair along the perimeter only at the respective peak or valley internal contact point of the respective individual sheet to form a bonded sheet pair.

* * * * *